US007843340B2

(12) United States Patent
Davis

(10) Patent No.: US 7,843,340 B2
(45) Date of Patent: Nov. 30, 2010

(54) MAIL DELIVERY ALERT SYSTEM

(76) Inventor: Willis Noland Davis, 5470 Bryant Hollow, Elkton, VA (US) 22827

( * ) Notice: Subject to any disclaimer, the term of this patent is extended or adjusted under 35 U.S.C. 154(b) by 194 days.

(21) Appl. No.: 12/167,449

(22) Filed: Jul. 3, 2008

(65) Prior Publication Data

US 2010/0001861 A1 Jan. 7, 2010

(51) Int. Cl.
*G08B 13/02* (2006.01)

(52) U.S. Cl. ..... 340/569; 340/539.1; 340/545.1; 340/545.6; 200/61.63; 232/17; 232/37; 232/45; 455/412.2

(58) Field of Classification Search ..... 340/569, 340/539.1, 545.1, 545.6, 545.7, 545.8; 232/17, 232/34, 36, 37, 20, 45; 455/412.1, 412.2; 200/61.63

See application file for complete search history.

(56) References Cited

U.S. PATENT DOCUMENTS 4,868,543 A 9/1989 Binkley
5,060,854 A * 10/1991 Armstrong ..... 232/37
5,575,422 A 11/1996 Peterman
6,275,154 B1 * 8/2001 Bennett et al. ..... 340/569
6,459,375 B1 * 10/2002 Wallace ..... 340/569
6,831,558 B1 * 12/2004 Andrew ..... 340/539.2
7,486,948 B1 * 2/2009 Vergon ..... 455/412.2
2005/0253715 A1 * 11/2005 Awobue ..... 340/569

* cited by examiner

*Primary Examiner*—Davetta W Goins
(74) *Attorney, Agent, or Firm*—Dale J. Ream

(57) ABSTRACT

A mail delivery alert system includes a mailbox housing that encloses an interior space that defines an open front. A door is pivotally coupled to the housing and is movable between open and closed configurations relative to the open front. A first sensor is positioned in the housing so as to detect an opening of the door and a second sensor is positioned so as to detect the presence of an article, such as mail, in the open space of the housing. The system includes a transmitter and a processor. The processor includes programming for actuating the transmitter to transmit an alert signal through the air upon the first sensor detecting an opening of the door and the second sensor detecting the presence of an article in the open space of the housing. The system includes a receiver remote from the housing for receiving the alert signal.

4 Claims, 6 Drawing Sheets

MAIL DELIVERY ALERT SYSTEM

BACKGROUND OF THE INVENTION

The present invention relates generally to mail receiving devices and, more particularly, to a mail delivery alert system that indicates to a resident when mail has been delivered and is ready to be retrieved.

Presently, a person spends time looking for the mailperson, waiting until they think the mailperson has delivered the mail, or waiting until they are sure the mailperson has delivered the mail before they go to the mailbox. If the resident goes to the mailbox and, in fact, the mailperson has not yet delivered the mail, he has unnecessarily expended the effort to go to the mailbox. This can be a frustrating experience and, for some people, very tiring or inconvenient.

Various devices have been proposed in the art for detecting mail delivery, such as U.S. Pat. Nos. 3,611,333, 6,222,451, and 6,831,888. Although assumably effective for their intended purposes, each of these proposed devices must be physically attached to an existing mailbox to operate.

Therefore, it would be desirable to have a mail delivery alert system that determines the presence of mail within a mailbox and alerts a resident through a remote receiver of such detection. Further, it would be desirable to have a mail delivery alert system that includes a unique code such that the remote receiver is alerted to the receipt of mail by the correct mailbox. In addition, it would be desirable to have a mail delivery system that minimizes false signals to the remote receiver.

SUMMARY OF THE INVENTION

A mail delivery alert system according to the present invention includes a mailbox housing that encloses an interior space that defines an open front. A door is pivotally coupled to the housing and is movable between open and closed configurations relative to the open front. A first sensor is positioned in the housing so as to detect an opening of the door and a second sensor is positioned so as to detect the presence of an article, such as mail, in the open space of the housing. The system includes a transmitter and a processor. The processor includes programming for actuating the transmitter to transmit an alert signal through the air upon the first sensor detecting an opening of the door and the second sensor detecting the presence of an article in the open space of the housing. The system includes a receiver remote from the housing for receiving the alert signal.

The processor also includes a predetermined code associated with the mailbox housing that is different from a code associated with any other mailbox housing and programming for actuating the transmitter to include the predetermined code with the alert signal.

Therefore, a general object of this invention is to provide a mail delivery alert system that signals a resident when mail has been delivered to a mailbox.

Another object of this invention is to provide a mail delivery alert system, as aforesaid, in which a mailbox transmits a unique code along with an alert signal such that a receiver is only activated by an alert signal from a predetermined mailbox.

Still another object of this invention is to provide a mail delivery alert system, as aforesaid, that prevents false signals that may otherwise be generated when a mailbox door is opened by a mail delivery person extracting outgoing mail.

Yet another object of this invention is to provide a mail delivery alert system, as aforesaid, in which a receiver of the mail alert signal may be mounted inside a residence remote from the mailbox.

Other objects and advantages of the present invention will become apparent from the following description taken in connection with the accompanying drawings, wherein is set forth by way of illustration and example, embodiments of this invention.

DETAILED DESCRIPTION OF THE INVENTION

A mail delivery alert system 10 according to the present invention will now be described in detail with reference to FIGS. 1 to 7 of the accompanying drawings. The mail delivery alert system 10 is an electronic mailbox 12 and receiver 44 that will alert a homeowner to when mail has been placed into the mailbox 12. The mailbox 12 may be placed along a curbside as in any traditional mailbox, and the receiver 44 may be placed inside a residence at a location of the resident's discretion.

Figure 1:
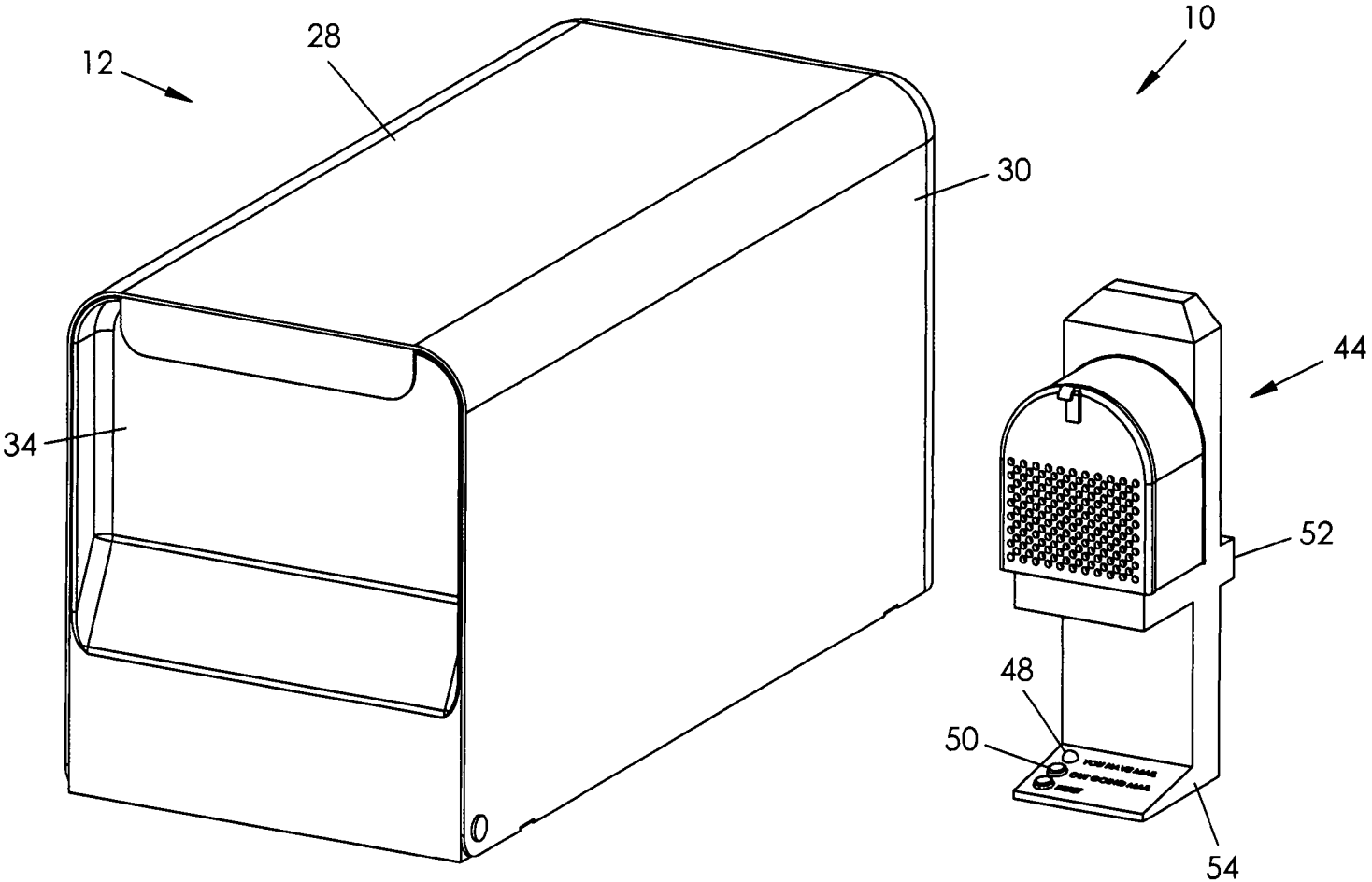
FIG. 1 is a perspective view of a mail delivery alert system according to a preferred embodiment of the present invention.
Figure 2:
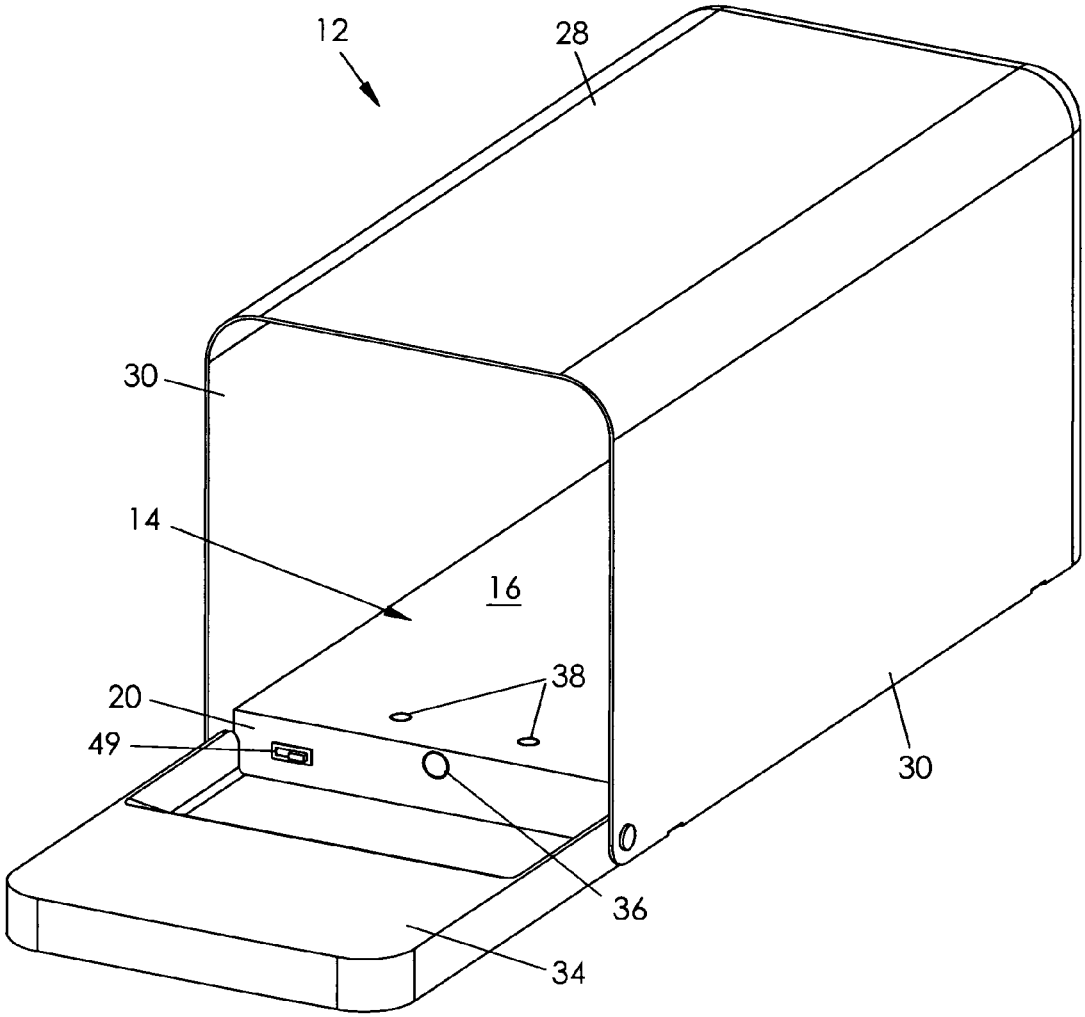
FIG. 2 is a perspective view of a mailbox housing on an enlarged scale as in FIG. 1 with a door in an open configuration.
Figure 3:
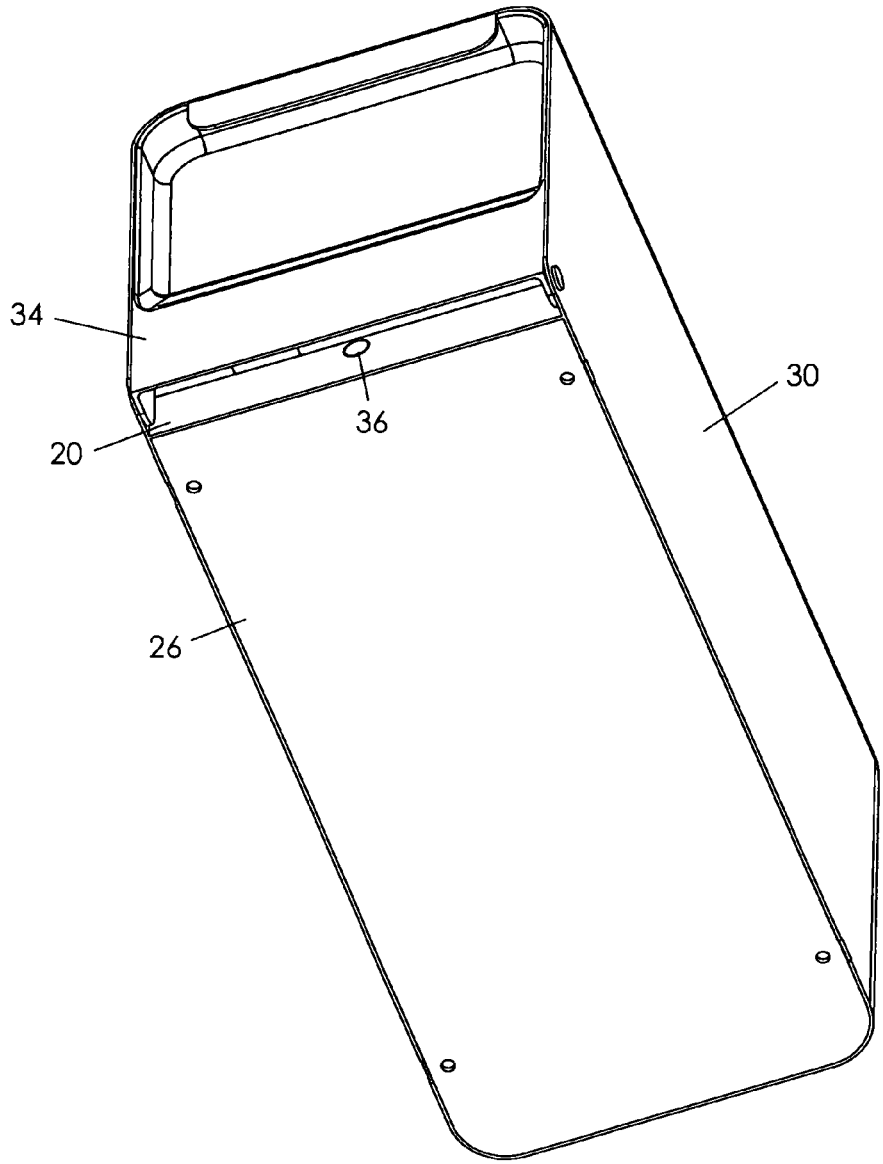
FIG. 3 is a bottom perspective view of the mailbox housing as in FIG. 1.
Figure 4:
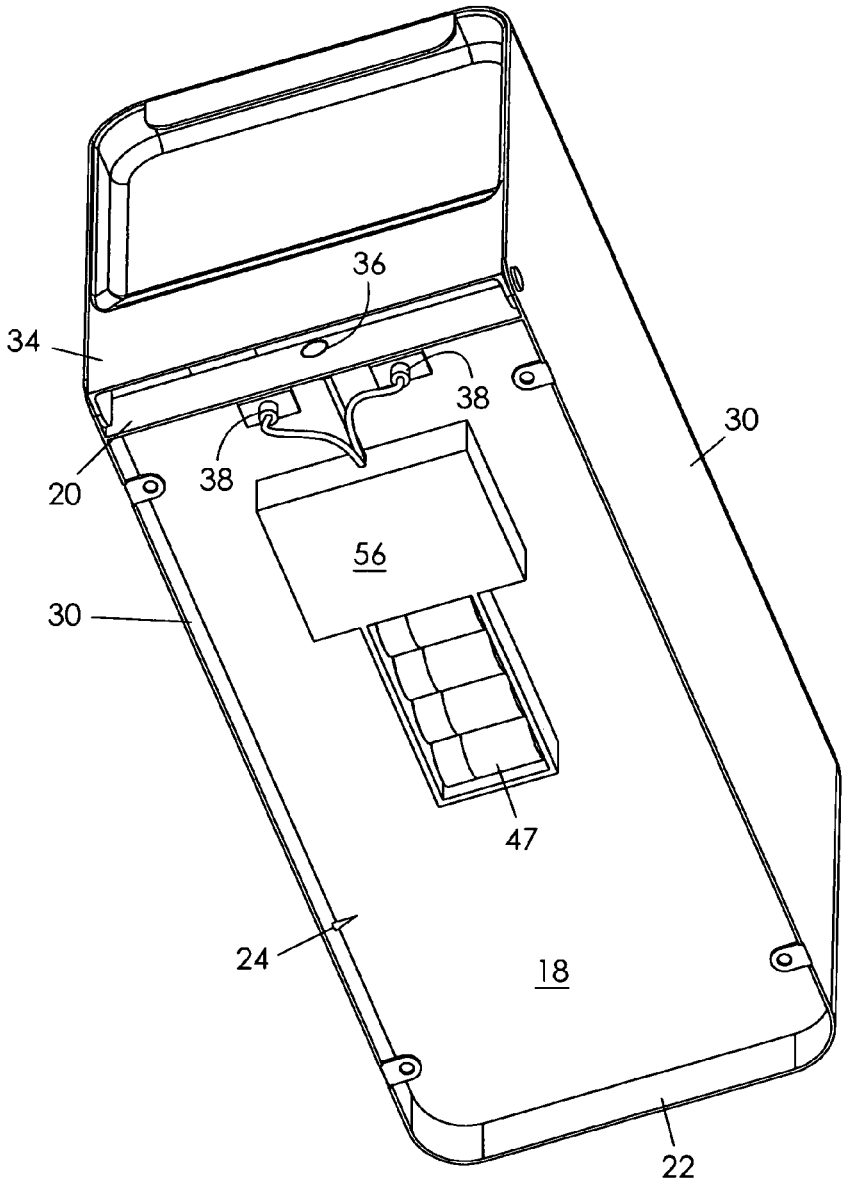
FIG. 4 is another perspective view as in FIG. 3 with a protective bottom panel removed.

The mailbox 12, also referred to herein as a mailbox housing, includes a bottom wall 14 and a top wall 28 generally opposed to and spaced apart from the bottom wall 14. The mailbox 12 also includes a pair of opposed side walls 30 that extend from opposed edges of the top wall 28 to a point below the bottom wall 14 (FIG. 4). The mailbox 12 further includes a rear wall (not shown) and defines an open front 32 (FIG. 2). Together, the walls of the mailbox 12 enclose an open space within the mailbox housing. A door 34 is pivotally coupled to the mailbox 12 at a lower edge of the side walls 30 and is selectively movable between open and closed configurations, the door 34 covering or enclosing the open front 32 when in the closed configuration.

The bottom wall 14 includes upper 16 and lower 18 surface as well as a front face 20 and a rear face 22 extending downwardly from the upper surface 16 thereof. Together, the front 20 and rear 22 faces along with the lower surface 18 of the bottom wall 14 and the side walls 30 that extend below the bottom wall 14 form a cavity 24. Electronic components of the present system 10 are mounted to the lower surface 18 of the bottom wall 14 as will be described in greater detail below. A bottom panel 26 may be removably attached to free edges of the front 20 and rear 22 faces of the bottom wall 14 and free edges of the side walls 30 (FIG. 3) so as to enclose the cavity 24 for protection of the electronic components.

A first sensor 36, such as a photosensor, is mounted in the mailbox housing 12 so as to detect an opening or closing of the door 34. Preferably, the first sensor 36 is positioned on the front face 20 of the bottom wall 14 such that it is aimed at the door 34 to detect light when the door is opened. Further, a second sensor 38 (or multiple second sensors), such as a light emitting diode or laser emitter with reflector, is positioned on the upper surface 16 of the bottom wall 14 and directed generally upward toward the top wall 28 where a reflector (not shown) may be mounted. Thus, these beams are broken when mail is deposited into the interior space. Although the generally vertical orientation is preferred, the position of the second sensor(s) may alternatively be horizontal.

The mail alert delivery system 10 further includes a transmitter 40 and a processor 42, the processor 42 being electrically connected to the transmitter, and to the first 36 and second 38 sensors. The processor 42 may be connected to a plurality of batteries 47 or other suitable power source. The electronic components are positioned in an electronics box 56 that may be mounted in the cavity 24 and situated between the lower surface 18 of the bottom wall 14 and the bottom panel 26.

Figure 7:
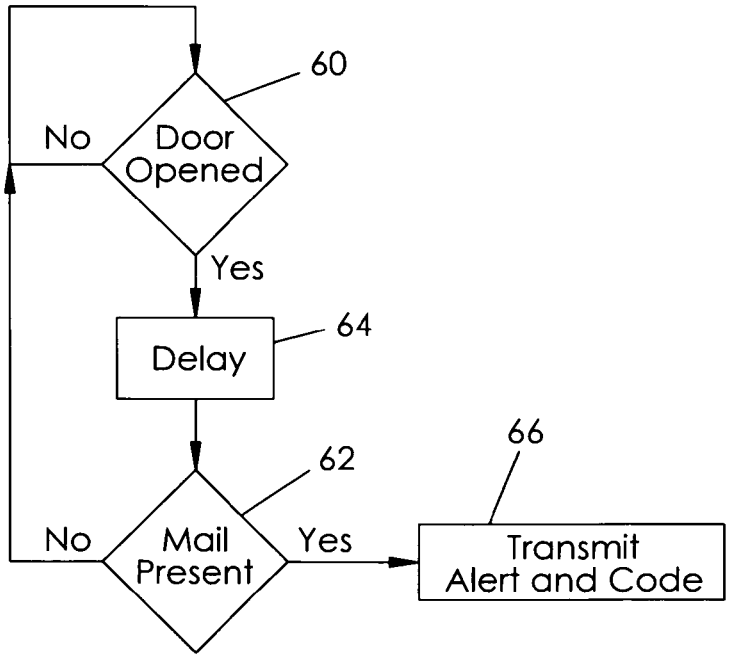
FIG. 7 is a flowchart illustrating the logic of the processor according to the present invention.

The processor 42 is electrically connected to the first 36 and second 38 sensors such that the sensors communicate with the processor 42 when they detect an opening of the mailbox door 34 or the presence of mail, respectively. The processor 42 may include programming for, essentially, polling the sensors at predetermined times to determine if they have detected a respective condition. More particularly, the processor 42 includes programming for determining if the door 34 has been opened or closed, presumably by a postal worker, as indicated at 60. Then, the processor 42 may include programming for determining if an article such as mail is detected 62. The processor 42 may delay the second test for a predetermined amount of time, as indicated at 64, so as to account for the time in which a postal worker may either deposit incoming mail into the mailbox 12 or remove outgoing mail from the mailbox 12. By these steps, the processor 42 is able to determine if mail has just been deposited or retrieved. This further avoids false alarms which would occur if the processor 42 only tested if the door 34 had been opened or if mail was present in the mailbox. If the processor 42 determines that incoming mail has been received, then it actuates a transmitter 40 to transmit a signal through the air, as indicated at reference numeral 66 (FIG. 7).

An on/off switch 49 may be positioned on the mailbox housing 12, such as adjacent the first sensor 69 for convenient user access and is preferably electrically connected to the batteries 47 and processor 42. It is understood the processor 42 and sensors 36, 38 are only energized when the on/off switch 49 is actuated. This enables a user to manually deactivate the system so as to save battery life during times of vacation or even for the remainder of a day and night following mail delivery.

Figure 5:
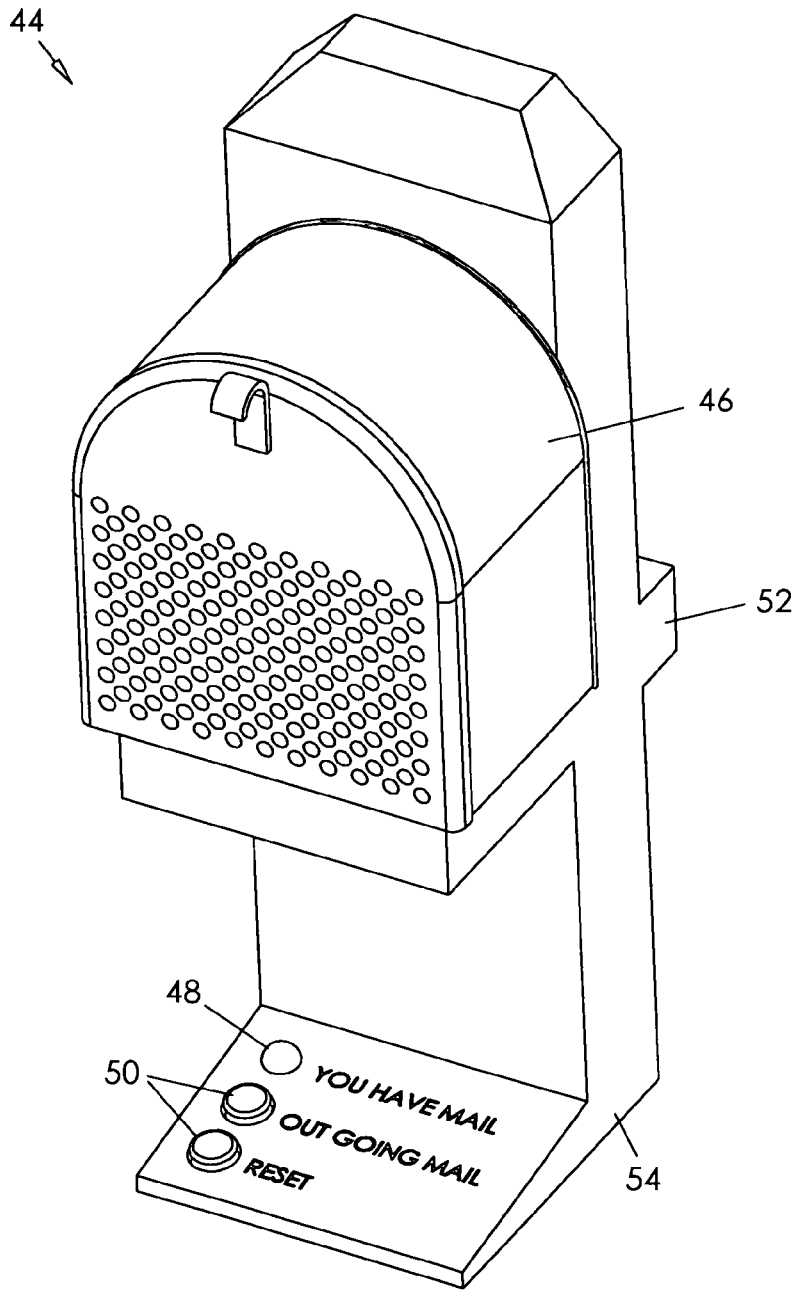
FIG. 5 is a perspective view on an enlarged scale of the receiver as in FIG. 1.
Figure 6:
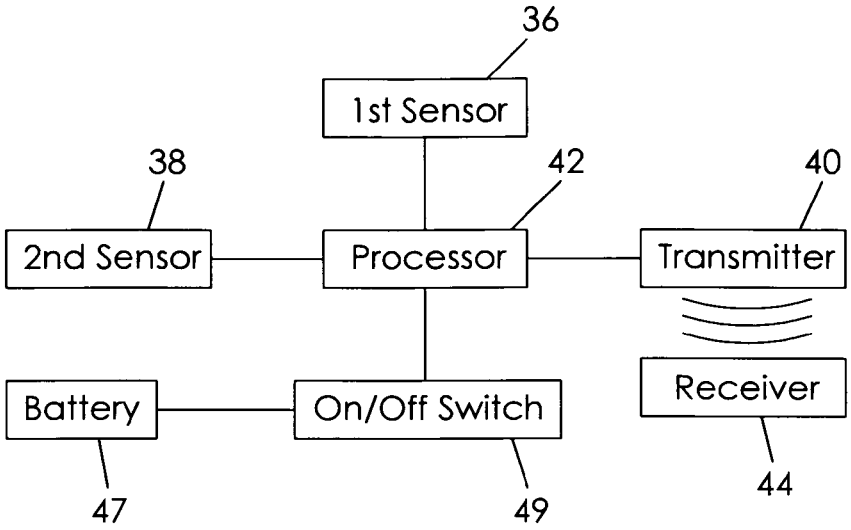
FIG. 6 is a block diagram of the electronic components of the present invention.

The mail delivery alert system 10 includes a receiver 44 (FIGS. 1, 5, and 6) capable of receiving an alert signal transmitted by the transmitter 40 (FIG. 6). The receiver 44 may include a receiver housing 46 having an ornamental appearance such as being configured in the form of a mailbox (FIG. 5). Preferably, the receiver housing 46 includes a wall mounting member 52 as well as a base member 54 suitable for resting on a level surface. The receiver 44 may include a visual indicator 48 that incoming mail has been detected and include input buttons 50 for indicating the presence of outgoing mail or to reset the system. The receiver 44 may also include an audio indicator (not shown) that, for instance, may play a musical tune to indicate the arrival of incoming mail. Thus, it is contemplated that the receiver housing 46 may includes another transmitter (not shown) that can transmit a signal to the mailbox 12 indicative of outgoing mail such that the processor 42 need not determine the existence thereof and may proactively satisfy that test.

Another aspect of the mail delivery alert system 10 is that the processor 42 may include a unique code, such as may be stored in a memory device (not shown), that uniquely identifies the mailbox. In other words, the unique identification code is different than the identification code of any other mailbox. The processor 42 includes programming to actuate the transmitter 40 to include this code in the alert signal whenever that alert signal is transmitted. The receiver 44, similarly, is capable of receiving only an alert signal having a predetermined identification code.

In use, a resident may use the mail delivery alert system 10 to determine when incoming mail has been deposited into a mailbox. A resident may place outgoing mail into the mailbox, understanding that it will be taken by a mail delivery person and perhaps replaced with incoming mail. It is also possible, of course, that it will not be replaced with any incoming mail—a circumstance that is more coming for elderly residents who may not receive as much mail volume. And, in such a circumstance, it would be desirable for a resident not be receive a false signal regarding receipt of mail and thereby make an unnecessary trip to their mailbox.

Accordingly, when a mailperson opens a mailbox, he will remove any outgoing mail that is already in the box. In this case, the processor 42 will determine that the door has opened and then, upon a small delay, will determine that no mail is present. Thus, no false alert signal will be transmitted to the receiver 44. However, if incoming mail is deposited into the mailbox 12, the processor 42 will detect this and actuate the transmitter 40 to transmit an alert signal. The unique identification code will also be transmitted with an alert signal. The receiver 44 is able to determine if an incoming signal is from a predetermined mailbox transmitter 40. If so, it will receive the signal and actuate the indicator 48.

It is understood that while certain forms of this invention have been illustrated and described, it is not limited thereto except insofar as such limitations are included in the following claims and allowable functional equivalents thereof.

The invention claimed is:

1. A mail delivery alert system, comprising:

a mailbox housing that encloses an interior space and that defines an open front;

a door pivotally coupled to said housing and movable between open and closed configurations relative to said open front;

wherein said housing includes a bottom wall having upper and lower surfaces, a top wall opposite said bottom wall, and opposed side walls extending from said top wall to a point beneath said bottom wall, such that said lower surface of said bottom wall and said side walls form a cavity;

a first sensor positioned on a front face of said bottom wall so as to detect an opening of said door;

a second sensor positioned on said bottom wall of said housing so as to detect the presence of an article of mail positioned on said bottom wall;

wherein said first sensor is a photosensor;

wherein said second sensor is a light emitting diode and reflector combination;

a transmitter;

a battery;

a processor electrically connected to said battery, said first and second sensors and to said transmitter, said processor including programming for actuating said transmitter to transmit an alert signal through the air upon said first sensor detecting an opening of said door and said second sensor detecting the presence of an article in said open space of said housing;

wherein said processor, said transmitter, and said first and second sensors are positioned in said cavity;

a receiver remote from said transmitter for receiving said alert signal;

wherein said processor includes:

a predetermined code associated with said mailbox housing that is different from a code associated with any other mailbox housing;

programming for actuating said transmitter to include said predetermined code with said alert signal; and programming requiring that said second sensor detects the presence of article a predetermined time after said first sensor detects an opening of said door before actuating said transmitter, whereby to avoid a false detection of mail indicative of a mail delivery person taking outgoing mail or being delayed in depositing incoming.

2. The system as in claim 1 wherein said receiver includes an ornamental housing in the form of a mailbox, said housing being mountable to a wall.

3. The system as in claim 1 wherein said housing includes a visual or audio indicator indicative of receipt of said alert signal.

4. The mail delivery alert system as in claim 1, further comprising an on/off switch mounted to said mailbox housing and electrically connected to said battery and said processor so as to selectively enable said processor to be energized or deenergized.

* * * * *